US007160150B2

(12) United States Patent
Annequin

(10) Patent No.: US 7,160,150 B2
(45) Date of Patent: Jan. 9, 2007

(54) METHOD OF MOUNTING AN ELECTRICAL CONNECTOR ON A COAXIAL CABLE, AND SUCH A CONNECTOR

(75) Inventor: Sébastien Annequin, Voiron (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 11/247,227

(22) Filed: Oct. 12, 2005

(65) Prior Publication Data

US 2006/0089046 A1 Apr. 27, 2006

(51) Int. Cl.
*H01R 9/05* (2006.01)

(52) U.S. Cl. ..... 439/585

(58) Field of Classification Search ..... 439/877, 439/879, 880, 882, 578–585
See application file for complete search history.

(56) References Cited

U.S. PATENT DOCUMENTS 3,539,976 A * 11/1970 Charles ..... 439/585
3,670,293 A * 6/1972 Garver ..... 439/585
4,269,469 A * 5/1981 Audic ..... 439/424
5,041,021 A * 8/1991 Sato ..... 439/585
5,073,128 A * 12/1991 Sirai et al. ..... 439/585
5,114,366 A * 5/1992 Sato ..... 439/585
5,120,241 A * 6/1992 Nakata et al. ..... 439/585
5,120,259 A * 6/1992 Nakata et al. ..... 439/585
5,133,677 A * 7/1992 Sato et al. ..... 439/585
5,145,409 A * 9/1992 Sato et al. ..... 439/585
5,171,166 A * 12/1992 Sato et al. ..... 439/578
5,246,384 A * 9/1993 Sato ..... 439/585
5,603,636 A * 2/1997 Kanou et al. ..... 439/585
5,913,694 A * 6/1999 Wright ..... 439/394
6,206,727 B1 * 3/2001 Aoyama et al. ..... 439/585
6,210,223 B1 * 4/2001 Aoyama et al. ..... 439/585
6,305,977 B1 * 10/2001 Ozaki ..... 439/578
6,384,335 B1 * 5/2002 Saito et al. ..... 174/74 R
6,402,551 B1 * 6/2002 Ozaki ..... 439/578
6,482,034 B1 * 11/2002 Ozaki ..... 439/585
6,533,609 B1 * 3/2003 Koide ..... 439/578
6,554,644 B1 * 4/2003 Koide ..... 439/585
6,709,290 B1 * 3/2004 Yoshida ..... 439/585
6,808,417 B1 * 10/2004 Yoshida ..... 439/585
2003/0089517 A1 5/2003 Takakazu et al.

FOREIGN PATENT DOCUMENTS

GB A 2 020 919 11/1979

* cited by examiner

*Primary Examiner*—Ross Gushi
(74) *Attorney, Agent, or Firm*—Oliff & Berridge, PLC

(57) ABSTRACT

A method of mounting an electrical connector on a coaxial cable may include: providing an electrical connector including: a central contact provided with at least one crimping portion; an insulating body including a bearing portion with a top face on which the crimping portion of the central contact bears, at least in part; and at least one empty space adjacent to the side wall of the bearing portion of the insulating body; and crimping the central contact onto the central conductor by using a crimping tool including a bearing surface bearing against the crimping portion of the central contact, the tool being movable into an end-of-stroke position in which the bearing surface of the tool extends at least in part into the empty space and beneath the crimping portion of the central contact.

27 Claims, 2 Drawing Sheets

METHOD OF MOUNTING AN ELECTRICAL CONNECTOR ON A COAXIAL CABLE, AND SUCH A CONNECTOR

The present invention relates to a method of mounting an electrical connector on a coaxial cable, to such an electrical connector, and to a tool for implementing the method.

BACKGROUND

European patent EP-B1-0 432 666 discloses an electrical connector for a coaxial cable, the connector comprising an outer sleeve, an insulating body inserted in said sleeve, and a central contact held by means of the insulating body. The central contact has two pairs of crimping tabs for crimping to the central conductor of the coaxial cable. On opposite sides of these crimping tabs, the outer sleeve has openings above and below the central contact that serve to admit crimping tools. Because the outer sleeve has an opening beneath the central contact, the performance of the connector can be affected at radio frequencies (RF).

Patent application GB-A-2 020 919 also discloses an electrical connector for a coaxial cable, that connector comprising a peripheral conductor element in which there is inserted an insulating sleeve secured to a conductive central element. Said element has crimping portions bearing against the insulating sleeve that can act as a support during crimping.

SUMMARY

The invention seeks in particular to improve the method of mounting an electrical connector on a coaxial cable.

The invention thus provides a method of mounting an electrical connector on a coaxial cable, the method comprising the following steps:

providing an electrical connector comprising:

- a central contact extending along a longitudinal axis and provided with at least one crimping portion suitable for being crimped on a central conductor of the coaxial cable;
- an insulating body comprising a bearing portion having a top face against which at least part of the crimping portion of the central contact bears, said bearing portion having at least one side wall extending substantially along said longitudinal axis, and in particular beneath the top face of the bearing portion;
- at least one empty space adjacent to the side wall of the bearing portion of the insulating body, at least part of said empty space extending beneath the crimping portion of the central contact, and in particular beneath the top face of the bearing portion;

crimping the central contact of the connector onto the central conductor of the cable using a crimping tool having a bearing surface for bearing against the crimping portion of the central contact, the tool being movable during crimping to an end-of-stroke position in which the bearing surface of the tool extends at least in part into said empty space and beneath the crimping portion of the central contact, and in particular beneath the top face of the bearing portion.

By means of the invention, the crimping portion of the central contact can be pressed against the bearing surface of the tool over a stroke of the tool that is relatively long during crimping, since this bearing surface of the tool can move down relatively far compared with the insulating body of the connector.

This makes it possible, in particular, to fold down the deformable branches of the crimping portion of the central contact in reliable manner, and specifically to avoid these branches buckling outwards while crimping is taking place.

In an implementation of the invention, the crimping portion of the central contact has a cross-section that is substantially U- or V-shaped, and in particular the two branches of the U- or V-shape are folded down towards each other during crimping. The above-mentioned empty space may extend in particular at least in part below a plane that is tangential to the base of the U- or V-shape.

Advantageously, the crimping tool includes an opening into which the crimping portion of the central contact engages during crimping, and the bearing surface of the tool presents a cross-section of a shape that flares towards the opening, at least in the vicinity of said opening.

This shape for the bearing surface of the tool makes it possible to cause the crimping portion of the central contact to be folded down progressively.

By way of example, the bearing surface of the tool may have two facing walls that define a flared shape, which two walls may be plane or otherwise, for example they could be curved.

The bearing surface may be formed in a cavity of the crimping tool, the cavity presenting an end wall of cross-section that is substantially m-shaped, for example.

Preferably, the depth of the cavity in the tool is selected to be sufficient to ensure that at the end of the crimping stroke of the tool, the bearing portion of the insulating body is engaged at least in part in said cavity.

As can be observed, the invention makes it possible to avoid having an opening through the connector for passing a crimping tool that is situated beneath the central contact, thus ensuring, in particular, that the assembly of the connector to the coaxial cable presents performance that is satisfactory in the radio frequency range.

Furthermore, at the end of the crimping stroke of the tool, the bearing surface of the tool may present a shape that substantially matches the shape of the side wall(s) of the bearing portion of the insulating body so that, where appropriate, the bearing surface of the tool can oppose any tendency of the bearing portion of the insulating body to spread under the effect of the force exerted by the crimping tool on the insulating body. The tool can thus take up a fraction of the forces to which the bearing portion of the insulating body is subjected, should that be necessary. If so desired, the invention thus makes it possible to use the crimping tool to exert a relatively high force on the crimping portion without damaging the bearing portion of the insulating body situated beneath it.

In an implementation of the invention, the bearing portion of the insulating body extends substantially entirely beneath the crimping portion of the central contact.

The bearing portion of the insulating body may have a cross-section of a shape that flares downwards, i.e. in a direction substantially opposite to the direction in which the top surface faces.

By way of example, the bearing portion may have at least one side wall that is plane.

In a variant, the bearing portion may have at least one side wall that is not plane, for example a wall that is curved.

In an implementation of the invention, the bearing portion of the insulating body includes at least one side wall with a first plane portion substantially adjacent to the top face of the bearing portion, and a second plane portion beneath the first plane portion and not parallel thereto.

If so desired, the bearing portion may include at least two facing parallel side walls, in particular plane walls.

In an implementation of the invention, the top face of the bearing portion of the insulating body includes a setback arranged to receive at least part of the crimping portion of the central contact, said setback extending in particular substantially parallel to the side walls of the bearing portion of the insulating body.

The insulating body may include a portion, in particular a substantially cylindrical portion, to which the bearing portion is connected, and which has a recess arranged therein to receive at least part of the central contact.

In an implementation of the invention, the insulating body is made of a polymer, in particular a high performance polymer.

The electrical connector may include an outer conducive body provided with a wall surrounding the central contact and the bearing portion of the insulating body, at least in part, said bearing portion resting against said wall of the outer body.

In an implementation of the invention, the depth of the cavity in the crimping tool lies substantially in the range one-half to two-thirds the inside radius of the outer body level with the crimping portion of the central contact.

Advantageously, the outer conductive body includes at least one crimping portion for crimping against at least one of the shielding braid and the outer insulating sheath of the coaxial cable.

In an implementation of the invention, the insulating body of the connector is set back from a crimping central contact of the connector that is used for crimping the shielding braid of the coaxial cable. The central contact of the connector may optionally be provided with an additional crimping portion for crimping to the inner insulating sheath of the coaxial cable.

The invention also provides an electrical connector for mounting on a coaxial cable, the connector comprising:

a central contact extending along a longitudinal axis and provided with at least one crimping portion suitable for being crimped on a central conductor of the coaxial cable;

an insulating body comprising a bearing portion having a top face against which at least part of the crimping portion of the central contact bears, said bearing portion having at least one side wall extending substantially along said longitudinal axis; and at least one empty space adjacent to the side wall of the bearing portion of the insulating body, said empty space extending at least in part beneath the crimping portion of the central contact.

In an embodiment of the invention, the central contact crimping portion has a cross-section that is substantially U- or V-shaped, with the branches of the U- or the V-shape flaring upwards, for example.

The bearing portion of the insulating body may extend substantially entirely beneath the central contact crimping portion and, where appropriate, may include in its top face a setback extending along the longitudinal axis and arranged to receive the central contact crimping portion, at least in part.

The invention also provides an electrical connector for mounting on a coaxial cable, the connector comprising:

an outer conductive body including at least one crimping portion, in particular a portion of U- or V-shaped cross-section, for crimping onto at least one of the shielding braid and the outer insulating sheath of the coaxial cable;

an insulating body secured to the outer conductive body; and a central contact held by the insulating body, each branch of the U- or V-shaped crimping portion of the outer body including at least one tooth at its top end, for example, and in particular including a plurality of teeth.

The invention also provides a crimping tool for crimping an electrical connector to a coaxial cable, the tool comprising:

an opening in which a crimping portion of the electrical connector is engaged during crimping; and a bearing surface presenting a cross-sectional shape that flares towards the opening, at least in the vicinity of said opening.

The crimping tool need not have any hinged portions, for example.

The invention also provides an assembly of an electrical connector of the invention and a coaxial cable.

BRIEF DESCRIPTION OF THE DRAWINGS

The invention can be better understood on reading the following detailed description of non-limiting embodiments of the invention, and on examining the accompanying drawings, in which.

MORE DETAILED DESCRIPTION

Figure 1:
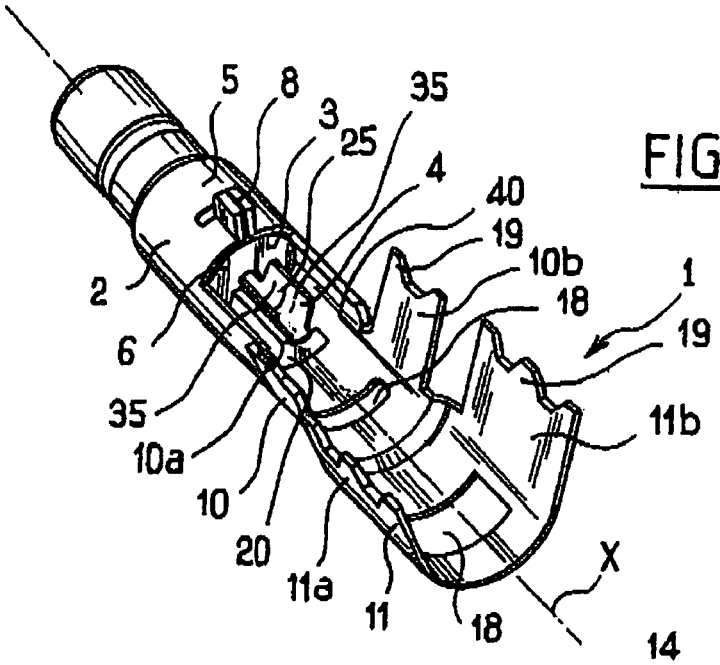
FIG. 1 is a diagrammatic and fragmentary perspective view of an electrical connector in accordance with the invention.
Figure 2:
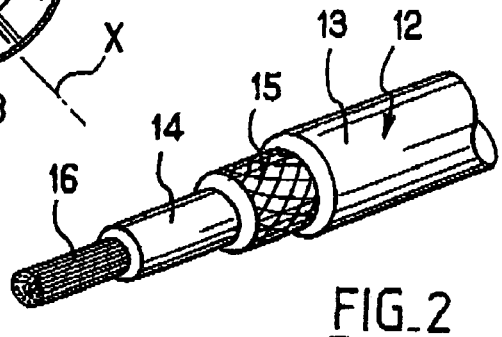
FIG. 2 is a diagrammatic and fragmentary perspective view of one end of a coaxial cable for mounting on the FIG. 1 connector.

FIG. 1 shows an electrical connector 1 in accordance with the invention, comprising an outer conductive body 2, an insulating body 3 secured to the outer body 2, and a central contact 4 held by the insulating body 3.

The outer body 2 comprises a cylindrical portion 5 of longitudinal axis X having a cylindrical portion 6 of the insulating body 3 secured therein, and a keying portion 8 in relief, e.g. formed by tabs projecting from the cylindrical portion 5, the keying portion 8 co-operating with a housing in a complementary electrical connector (not shown).

The outer body 2 further comprises two crimping portions 10 and 11 each of substantially U-shaped cross-section perpendicular to the axis X.

The crimping portions 10 and 11 comprise respective pairs of fold-down branches 10*a* & 10*b* and 11*a* & 11*b* respectively serving to crimp onto the shielding braid 15 and onto the outer insulating sheath 13 of a coaxial cable 12.

Each of these crimping portions 10 and 11 is provided with a respective opening 18 situated between its two fold-down branches 10*a* & 10*b* or 11*a* & 11*b*, leaving room, during crimping, for a fraction of the shielding braid 15 or of the outer insulating sheath 13 to project slightly through the opening 18, thus improving anchoring of the shielding braid 15 and the outer insulating sheath 13 within the connector.

Each of the branches 10*a*, 10*b*, 11*a*, and 11*b* has a plurality of teeth 19 at its end, in particular to surround better the shielding braid 15 or the outer insulating sheath 13.

Figure 3:
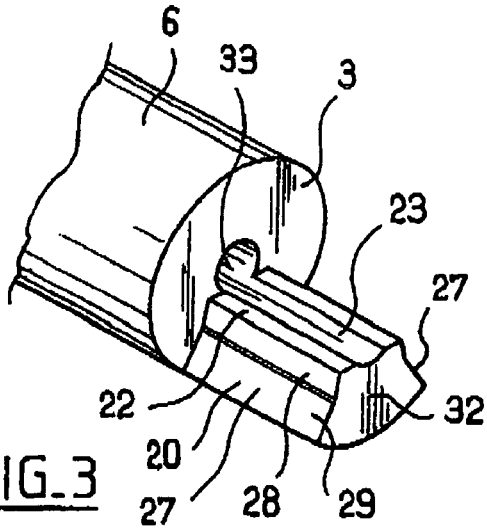
FIG. 3 is a diagrammatic and fragmentary perspective view showing the insulating body of the FIG. 1 connector.

The insulating body 3 has a bearing portion 20 extending along the axis X and connected to the cylindrical portion 6, as can be seen in FIG. 3, in particular.

The bearing portion 20 has a top face 22 provided with a setback 23 of axis X arranged to receive a crimping portion 25 of the contact element 4, at least in part, as shown in FIG. 1.

The bearing portion 20 presents a bottom wall 32 resting on a cylindrical wall of the outer body 2.

In the example described, the bearing portion 20 has two facing walls 27 that diverge downwards, each comprising a first plane portion 28 substantially adjacent to the top face 22 and a second plane portion 29 below the first portion 28 and not parallel therewith.

Figure 4:
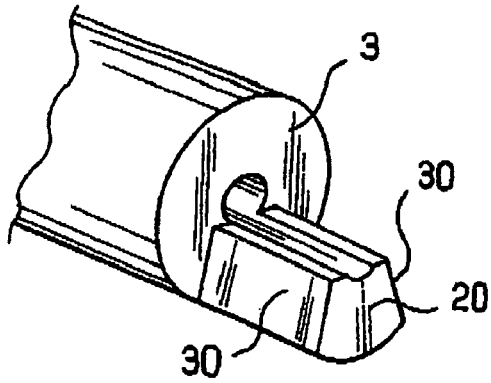
FIGS. 4 and 5 are diagrammatic and fragmentary perspective views of other insulating bodies in other connectors in accordance with the invention.
Figure 5:
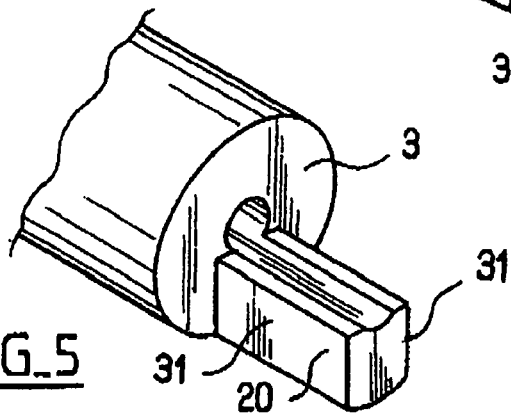

In a variant, as shown in FIG. 4, the bearing portion 20 of the insulating body 3 may have two facing side walls 30 that are completely plane and that diverge downwards.

In another variant, the bearing portion 20 of the insulating body 20 may have two side walls 31 that are plane and parallel.

In the example described, the insulating body is made of a high performance polymer. Naturally, the invention is not restricted to an insulating body made with this type of material.

The cylindrical portion 6 of the insulating body 3 includes a recess 33 serving to receive one end of the central contact 4 when the crimping portion 25 is placed on the top face 22 of the bearing portion 20.

The crimping portion 25 is of U-shaped cross-section, with two facing branches 35 that can be folded down towards each other around the central conductor 16 of the coaxial cable 12, during crimping. The branches 35 flare apart upwards, prior to crimping, as shown in particular in FIG. 6. In a variant, the branches of the U-shape could initially be parallel.

In a variant that is not shown, the crimping portion 25 could have more than two deformable branches, for example it could have two pairs of facing branches.

The electrical connector 1 has two empty spaces 40 formed on either side of the bearing portion 20 of the insulating body 3.

Figure 6:
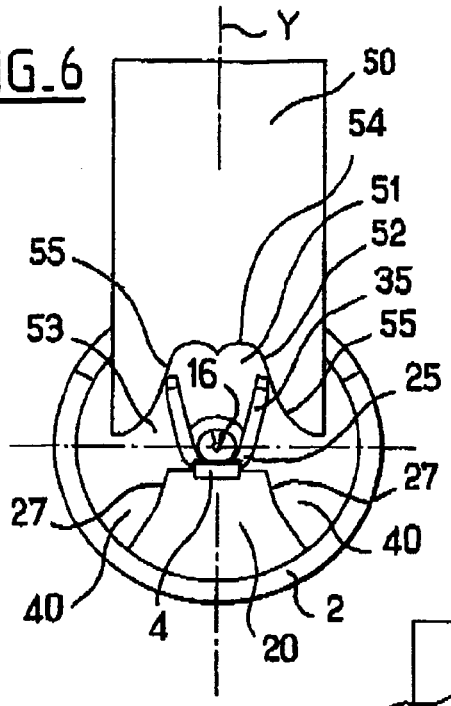
FIGS. 6 to 8 are diagrams showing three successive steps in crimping a coaxial cable onto the FIG. 1 connector.

Each empty space 40 is adjacent to one of the side walls 27 of the bearing portion 20 and extends under the crimping portion 25 of the central contact 4 as far as the outer conductor 2, as can be seen in particular in FIG. 6.

Figure 7:
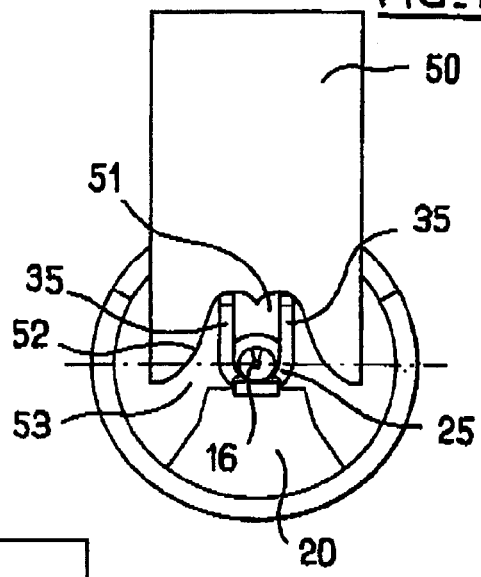
Figure 8:
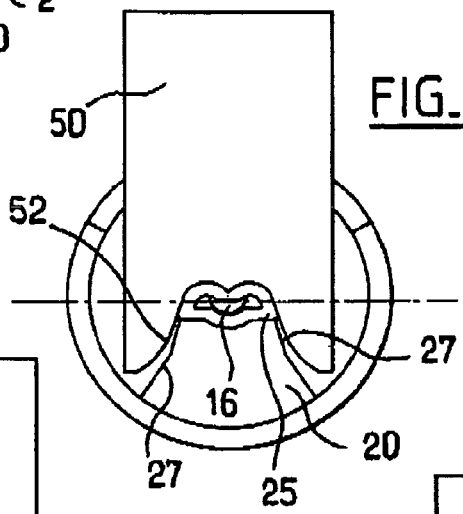

In order to crimp the crimping portion 25 onto the central conductor 16 of the coaxial cable 12, a crimping tool 50 is used as shown diagrammatically in cross-section in FIGS. 6 to 8.

This tool 50 includes a cavity 51 defining a bearing surface 52 capable of bearing against the crimping portion 25 of the central contact 4.

At least in the vicinity of an opening 53 through which the crimping portion 25 of the central contact 4 is engaged during crimping, the bearing surface 52 presents a cross-section that flares downwards.

By way of example, the bearing surface 52 may comprise two facing curved walls 55 that join together via an end wall 54 of the cavity 51, which end wall 54 presents a cross-section that is m-shaped, for example.

In the example described, the shape of the bearing surface 52 is selected so as to match substantially the shape of at least a portion of the side walls 27 of the bearing portion 20 at the end of the stroke of the tool 50 during crimping, as shown in FIG. 8.

While the central contact 4 is being crimped onto the central conductor 16 of the coaxial cable 12, the tool 50 is moved along an axis Y perpendicular to the axis X, as shown in FIGS. 6 to 8.

The downwardly-flared shape of the bearing surface 52 of the tool 50 and the relatively great depth of the cavity 51 enable the branches 35 of the U-shape of the crimping portion 25 to be folded down progressively so as to avoid any buckling of these branches 35 in an outward direction.

The bearing surface 52 engages in the empty spaces 40 beneath the crimping portion 25 after the tool 50 has moved along a stroke of a certain magnitude, as shown in FIG. 8.

At the end of crimping, as shown in FIG. 8, the branches 35 have been folded down towards each other around the central conductor 16.

In the example described, at the end of the stroke, the tool 50 exerts a force that may be of the order of 1300 newtons (N) on the assembly constituted by the central contact 4 and the bearing portion 20.

Because the bearing surface 52 of the tool 50 serves to limit any spreading of the bearing portion 20, said portion can withstand relatively high forces without being damaged.

The bearing surface 52 of the tool 50 may be downwardly flared to a greater or lesser extent as a function of the shape of the side walls of the bearing portion 20.

Figure 9:
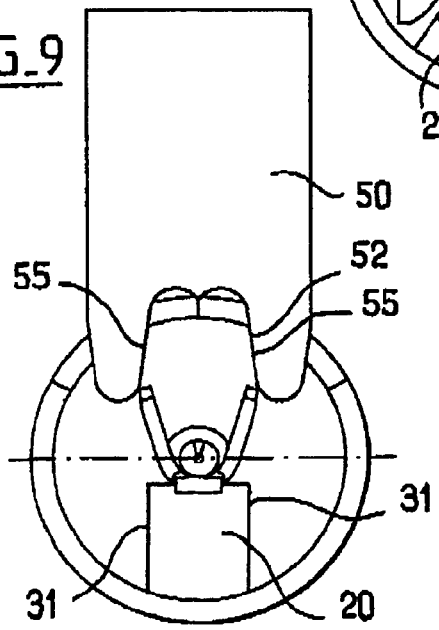
FIGS. 9 and 10 are diagrams showing two successive steps of crimping a coaxial cable onto an electrical connector constituting another embodiment of the invention.
Figure 10:
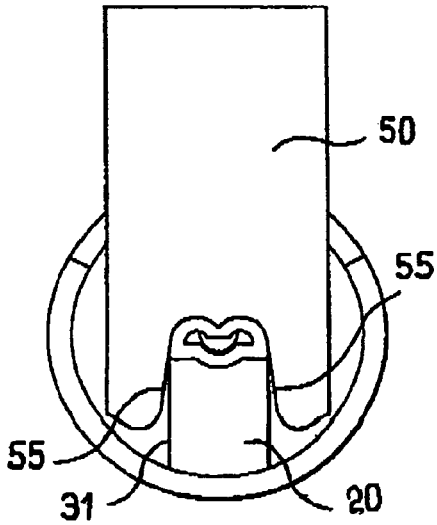

As shown in FIGS. 9 and 10, when the bearing portion 20 has side walls 31 that are plane and parallel, the bearing surface 52 of the tool 50 may flare downwards to a smaller extent, e.g. having two facing walls 55 that are substantially plane.

Naturally, the invention is not limited to the embodiments described above.

For example, if so desired, at the end of the crimping stroke, the bearing surface of the crimping tool need not match the shape of the side walls of the bearing portion of the insulating body.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An electrical connector for mounting on a coaxial cable, the connector comprising:

a central contact extending along a longitudinal axis and provided with at least one crimping portion configured to be crimped on a central conductor of the coaxial cable;

an insulating body comprising a bearing portion including a top face against which at least part of the crimping portion of the central contact bears, said bearing portion including at least one side wall extending substantially along said longitudinal axis, and at least one empty space adjacent to the side wall of the bearing portion of the insulating body, at least part of said empty space extending beneath the face of the bearing portion.

2. A connector according to claim 1, wherein the crimping portion of the central contact includes a cross-section that is substantially one of U- and V-shaped.

3. A connector according to claim 1, wherein the bearing portion of the insulating body extends substantially entirely beneath the crimping portion of the central contact.

4. A connector according to claim 1, wherein the bearing portion of the insulating body comprises at least one planar side wall.

5. A connector according to claim 1, wherein the insulating body is made of a high performance polymer.

6. A connector according to claim 1, wherein the top face of the bearing portion of the insulating body comprises a setback extending along the longitudinal axis.

7. A connector according to claim 1, wherein the bearing portion of the insulating body includes a cross-section of a shape that flares downward.

8. A connector according to claim 7, wherein the bearing portion of the insulating body comprises at least one side wall with a first plane portion substantially adjacent to the top face of the bearing portion, and with a second plane portion below the first portion and not parallel thereto.

9. A connector according to claim 1, wherein the bearing portion comprises two side walls that are parallel.

10. A connector according to claim 9, wherein the side walls are planar.

11. A connector according to claim 1, wherein the insulating body comprises a supplemental portion, to which the bearing portion is connected, and includes a recess arranged to receive at least part of the central contact.

12. A connector according to claim 11, wherein said supplemental portion comprises a substantially cylindrical portion.

13. A connector according to claim 1, wherein the electrical connector comprises an outer body provided with a wall surrounding the central contact and the bearing portion of the insulating body, at least in part, said bearing portion resting against said wall of the outer body.

14. A connector according to claim 13, wherein the outer conductive body comprises at least one crimping portion configured to be crimped against at least one of shielding braids and the outer insulating sheath of the coaxial cable.

15. A connector according to claim 14, wherein said crimping portion configured to be crimped against at least one of shielding braids and the outer insulating sheath of the coaxial cable includes a cross-section that is one of U- and V-shaped, with each branch of the U- or V-shape being provided with at least one tooth.

16. A method of mounting an electrical connector on a coaxial cable, the method comprising:

providing an electrical connector comprising:

a central contact extending along a longitudinal axis and provided with at least one crimping portion configured to be crimped on a central conductor of the coaxial cable;

an insulating body comprising a bearing portion including a top face against which at least part of the crimping portion of the central contact bears, said bearing portion including at least one side wall extending substantially along said longitudinal axis; and at least one empty space adjacent to the side wall of the bearing portion of the insulating body, at least part of said empty space extending beneath the top face of the bearing portion; and crimping the central contact of the connector onto the central conductor of the coaxial cable using a crimping tool including a bearing surface configured to bear against the crimping portion of the central contact, the tool being movable during crimping to an end-of-stroke position in which the bearing surface of the tool extends at least in part into said empty space and beneath the crimping portion of the central contact.

17. A method according to claim 16, wherein the crimping portion of the central contact includes a cross-section that is substantially U- or V-shaped.

18. A method according to claim 16, wherein the crimping tool comprises an opening into which the crimping portion of the central contact engages during crimping, and wherein the bearing surface of the crimping tool includes a cross-section of a shape that flares toward the opening, at least in a vicinity of said opening.

19. A method according to claim 16, wherein the bearing surface of the crimping tool includes a shape that, at an end of a stroke of the crimping tool during crimping, substantially matches a shape of the at least one side wall of the bearing portion of the insulating body.

20. A method according to claim 16, wherein the bearing portion of the insulating body extends substantially entirely beneath the crimping portion of the central contact.

21. A method according to claim 16, wherein the bearing portion of the insulating body comprises a setback in the top face.

22. A method according to claim 16, wherein the bearing surface is formed in a cavity of the crimping tool.

23. A method according to claim 22, wherein the cavity includes an end wall of cross-section that is substantially in-shaped.

24. A crimping tool for implementing the method according to claim 16, the tool comprising:

an opening in which a crimping portion of the electrical connector is engaged during crimping; and a bearing surface including a cross-sectional shape that flares toward the opening, at least in a vicinity of said opening.

25. An electrical connector for mounting on a coaxial cable, the connector comprising:

a central contact extending along a longitudinal axis and provided with at least one crimping portion configured to be crimped on a central conductor of the coaxial cable;

an insulating body comprising a bearing portion including a top face against which at least part of the crimping portion of the central contact bears, said bearing portion including at least one side wall extending substantially along said longitudinal axis, the top face of the bearing portion of the insulating body comprising a setback extending along the longitudinal axis, and at least one empty space adjacent to the side wall of the bearing portion of the insulating body, at least part of said empty space extending beneath the crimping portion of the central contact.

26. An electrical connector for mounting on a coaxial cable, the connector comprising:

a central contact extending along a longitudinal axis and provided with at least one crimping portion configured to be crimped on a central conductor of the coaxial cable;

an insulating body comprising a bearing portion including a top face against which at least part of the crimping portion of the central contact bears, said bearing portion including at least one side wall extending substantially along said longitudinal axis, the bearing portion of the insulating body including a cross-section of a shape that flares downward, and at least one empty space adjacent to the side wall of the bearing portion of the insulating body, at least part of said empty space extending beneath the crimping portion of the central contact.

27. An electrical connector for mounting on a coaxial cable, the connector comprising:

a central contact extending along a longitudinal axis and provided with at least one crimping portion configured to be crimped on a central conductor of the coaxial cable;

an insulating body comprising a bearing portion including a top face against which at least part of the crimping portion of the central contact bears, the bearing portion comprising two side walls that are parallel, and at least one empty space adjacent to the side wall of the bearing portion of the insulating body, at least part of said empty space extending beneath the crimping portion of the central contact.

* * * * *